US010870557B2

(12) United States Patent
Ma

(10) Patent No.: US 10,870,557 B2
(45) Date of Patent: Dec. 22, 2020

(54) COMPACT BELT TERMINATION ASSEMBLY

(71) Applicant: Otis Elevator Company, Farmington, CT (US)

(72) Inventor: Jun Ma, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 148 days.

(21) Appl. No.: 15/782,657

(22) Filed: Oct. 12, 2017

(65) Prior Publication Data

US 2019/0112156 A1 Apr. 18, 2019

(51) Int. Cl.
*B66B 7/08* (2006.01)
*B66B 7/06* (2006.01)

(52) U.S. Cl.
CPC ..... *B66B 7/085* (2013.01); *B66B 7/062* (2013.01); *B66B 7/08* (2013.01)

(58) Field of Classification Search
CPC ..... B66B 7/085
See application file for complete search history.

(56) References Cited

U.S. PATENT DOCUMENTS

| | | | | |
|---|---|---|---|---|
| 3,905,711 | A | 9/1975 | Rogers | |
| 4,066,368 | A | 1/1978 | Mastalski et al. | |
| 4,602,891 | A | 7/1986 | McBride | |
| 5,090,923 | A | 2/1992 | Kenyon et al. | |
| 6,662,408 | B2 | 12/2003 | Perez et al. | |
| 7,647,675 | B2 | 1/2010 | Ach | |
| 8,181,312 | B2 | 5/2012 | Attinger et al. | |
| 8,505,173 | B2 | 8/2013 | Pitts et al. | |
| 9,004,232 | B2 * | 4/2015 | Attinger | B66B 7/085 187/411 |
| 10,562,740 | B2 * | 2/2020 | Zaidi | F16G 11/04 |
| 2016/0185572 | A1 | 6/2016 | Lehtinen et al. | |
| 2016/0272466 | A1 | 9/2016 | Helenius | |
| 2016/0355378 | A1 | 12/2016 | Lehtinen et al. | |
| 2017/0036891 | A1 | 2/2017 | Lehtinen et al. | |

FOREIGN PATENT DOCUMENTS

| | | | |
|---|---|---|---|
| CN | 106882687 | A | 6/2017 |
| CN | 106926252 | A | 7/2017 |
| CN | 106986252 | A | 7/2017 |
| WO | 2015185153 | A1 | 12/2015 |

OTHER PUBLICATIONS

European Patent Office, Extended European Search Report for Application No. 18199817, dated Mar. 4, 2019, 9 pages.
CN Search Report for CN Application No. 201811183052.1 dated Mar. 3, 2020 8 pages.
EP Office Action; Application No. 18199817.0-1017; dated Aug. 24, 2020; 6 pages.

* cited by examiner

*Primary Examiner* — Diem M Tran
(74) *Attorney, Agent, or Firm* — Cantor Colburn LLP

(57) ABSTRACT

A termination device for a suspension member of an elevator system includes a housing including a socket defined by two face plates and two side plates. At least one of the face plates and at least one of the side plates are integrally formed. A wedge is receivable within the socket with the suspension member. The wedge is configured to cooperate with the housing to apply a clamping force to the suspension member in response to an axial load acting on the suspension member.

12 Claims, 6 Drawing Sheets

COMPACT BELT TERMINATION ASSEMBLY

BACKGROUND

The subject matter disclosed herein relates to elevator systems. More particularly, the present disclosure relates to termination of suspension members of elevator systems.

A typical elevator system includes an elevator car, suspended by one or more suspension members, typically a rope or belt that moves along a hoistway. The suspension member includes one or more tension members and is routed over one or more sheaves, with one sheave, also known as a drive sheave, operably connected to a machine. The machine drives movement of the elevator car via interaction of the drive sheave with the suspension member. The elevator system further typically includes a counterweight interactive with the suspension member. One or more of the ends of the suspension member are terminated, or retained in the hoistway.

Elevator rope or belt terminations typically rely on the ability to either wrap the rope or belt around a wedge, or the ability to spread the individual wires of the rope and create a knob by placing the spread wires into a socket and potting with a material such as an epoxy-based potting compound. These typical methods do not work for suspension members that utilize tension members formed from or including unidirectional fibers in a rigid matrix. In such an arrangement, the tension member will fracture if bent around a typical wedge radius, and the fibers are not able to be spread and bent to be utilized in the potted arrangement. Methods of terminating the suspension member which do not require such deformation occupy significant amounts of space and require a relatively high clamping force to retain the suspension member. Such methods are prone to undertightening, resulting in slippage of the suspension member.

BRIEF SUMMARY

In one embodiment, a termination device for a suspension member of an elevator system includes a housing including a socket defined by two face plates and two side plates. At least one of the face plates and at least one of the side plates are integrally formed. A wedge is receivable within the socket with the suspension member. The wedge is configured to cooperate with the housing to apply a clamping force to the suspension member in response to an axial load acting on the suspension member.

Additionally or alternatively, in this or other embodiments the two face plates are arranged opposite one another and the two sides plates extend between the two face plates, the two side plate being arranged opposite one another.

Additionally or alternatively, in this or other embodiments the housing is substantially symmetrical about a plane extending between and generally parallel to the two face plates.

Additionally or alternatively, in this or other embodiments the two face plates and a first side plate of the two side plates are integrally formed.

Additionally or alternatively, in this or other embodiments a second side plate of the two side plates is coupled to the two face plates.

Additionally or alternatively, in this or other embodiments the second side plate is coupled to the two face plates without a weld.

Additionally or alternatively, in this or other embodiments the second side plate includes a plurality of plate tabs and the two face plates include a plurality of plate openings, the plurality of plate tabs being receivable within the plurality of plate openings.

Additionally or alternatively, in this or other embodiments one of the two face plates and the two side plates are integrally formed.

Additionally or alternatively, in this or other embodiments each of the side plates defines a housing inner surface configured to engage the suspension member.

Additionally or alternatively, in this or other embodiments the housing inner surface defined by at least one of the side plates tapers inwardly toward the suspension member with increasing distance from the suspension member end.

Additionally or alternatively, in this or other embodiments the housing inner surface includes one or more friction enhancing features.

According to another embodiment, an elevator system includes a hoistway associated with a building structure, an elevator car disposed in the hoistway, a suspension member operably connected to the elevator car to suspend and/or drive the elevator car along the hoistway, and a termination device disposed in the hoistway and operably connected to an end of the suspension member. The termination device includes a housing including a socket defined by two face plates and two side plates. At least one of the face plates and at least one of the side plates are integrally formed. A wedge is receivable within the socket with the suspension member. The wedge is configured to cooperate with the housing to apply a clamping force to the suspension member in response to an axial load acting on the suspension member.

Additionally or alternatively, in this or other embodiments one of the side plates is arranged along a direction of load transfer from the elevator car to the building structure.

According to another embodiment, method of manufacturing a termination device includes contouring a piece of material associated with at least two sides of a housing, bending the piece of material to form a first piece, and coupling a second piece to the first piece to form the housing.

Additionally or alternatively, in this or other embodiments coupling the second piece to the first piece does not include welding the second piece to the first piece.

Additionally or alternatively, in this or other embodiments bending the piece of material to form the first piece of the housing and coupling the second piece to the first piece occur simultaneously.

Additionally or alternatively, in this or other embodiments the second piece includes a plurality of tabs and the first piece of the housing includes a plurality of openings corresponding to the plurality of tabs, and coupling the second piece to the first piece includes receiving the plurality of tabs within the plurality of openings.

Additionally or alternatively, in this or other embodiments the housing includes two face plates and two side plates, and bending the piece of material further comprises: forming a first bend to define a face plate integrally formed with a side plate.

Additionally or alternatively, in this or other embodiments bending the piece of material further comprises forming a second bend to define another face plate integrally formed with the side plate, the face plate and the another face plate being disposed on opposite ends of the side plate.

Additionally or alternatively, in this or other embodiments comprising forming one or more or more friction enhancing features in the two side plates.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
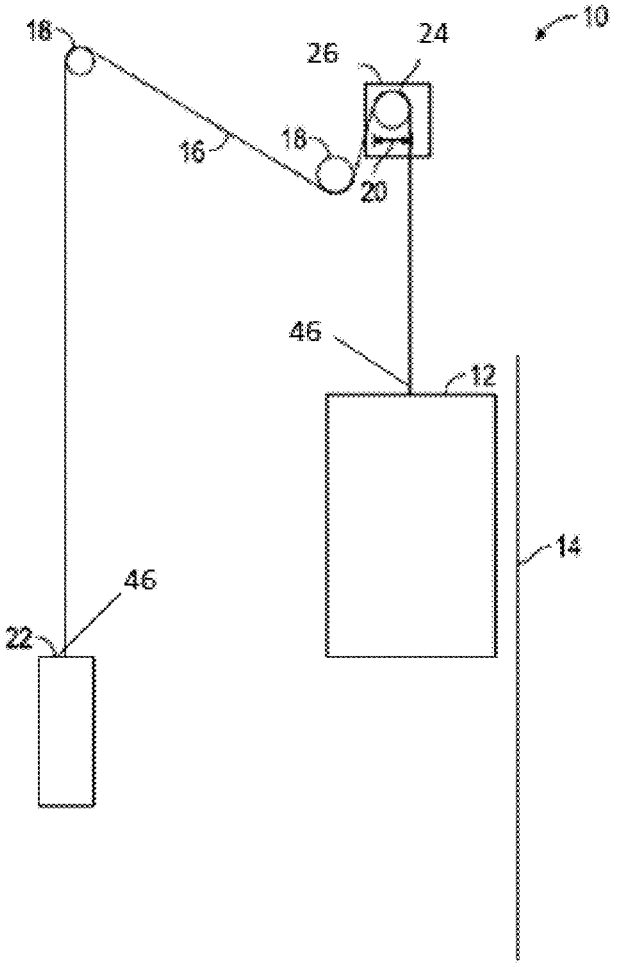
FIG. 1 is a schematic view of an exemplary elevator system.

Shown in FIG. 1, is a schematic view of an exemplary traction elevator system 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves could be a traction sheave 24. The traction sheave 24 is driven by a machine 26. Movement of drive sheave by the machine 26 drives, moves and/or propels (through traction) the one or more belts 16 that are routed around the traction sheave 24. At least one of the sheaves 18 could be a diverter, deflector or idler sheave. Diverter, deflector or idler sheaves are not driven by a machine 26, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 or only one side of the one or more belts 16 engages the one or more sheaves 18. The embodiment of FIG. 1 shows a 1:1 roping arrangement in which the one or more belts 16 terminate at the car 12 and counterweight 22, while other embodiments may utilize other roping arrangements.

The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

Figure 2:
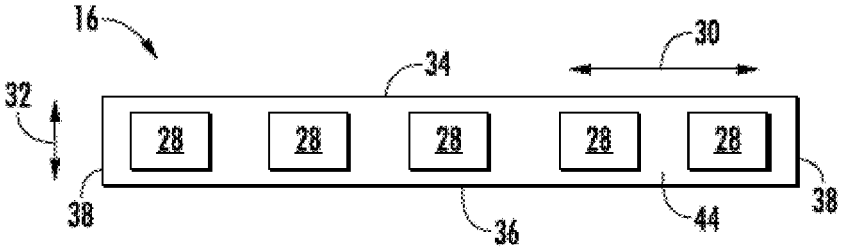
FIG. 2 is a cross-sectional view of an embodiment of a belt for an elevator system.

FIG. 2 provides a cross-sectional schematic of an example of a belt 16 construction or design. The belt 16 includes a plurality of tension elements 28 extending longitudinally along the belt 16. While the tension elements 28 in the embodiment of FIG. 2 are rectangular in cross-section, it is to be appreciated that other cross-sectional shapes, such as circular, may be utilized in other embodiments. The tension elements 28 may be at least partially encased in a jacket 44, in some embodiments formed from a polymer material such as a thermoplastic polyurethane (TPU). The belt 16 has a belt width 30 and a belt thickness 32, with an aspect ratio of belt width 30 to belt thickness 32 greater than one. The belt 16 defines a traction side 34, which is interactive with the traction sheave 24 and a back side 36 opposite the traction side 34. The belt 16 further defines belt edges 38 extending between the traction side 34 and the back side 36.

Figure 3:
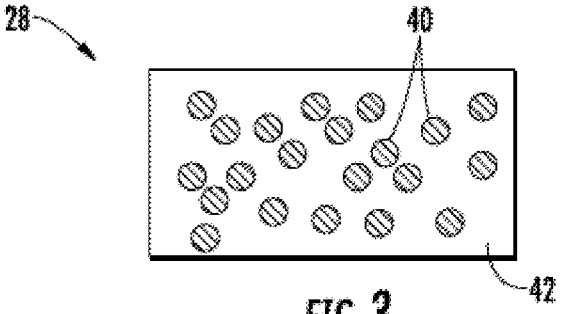
FIG. 3 illustrates an embodiment of a tension element for a belt of an elevator system.

Referring now to FIG. 3, the tension elements 28 include a plurality of fibers 40 bonded to a polymer matrix 42 to form the tension elements 28. The fibers 40 are continuous or discontinuous or combination of continuous and discontinuous over the belt 16 length and, oriented generally such that a fiber 40 length is directed along the belt 16 length. The fibers 40 may be formed of one or more of a number of materials, such as carbon, glass, polyester, nylon, aramid or other polyimide materials. Further, the fibers 40 may be organized into a grouping, such as a spun yarn. The matrix 42 may be formed of, for example a thermoset or thermoplastic material. The tension element 28 is further configured to have a fiber 40 density of 30% to 70% fibers 40 per unit of volume. In some embodiments, the fibers 40 may vary in size, length or circumference and may further be intentionally varied to provide a selected maximum fiber 40 density.

Figure 4A:
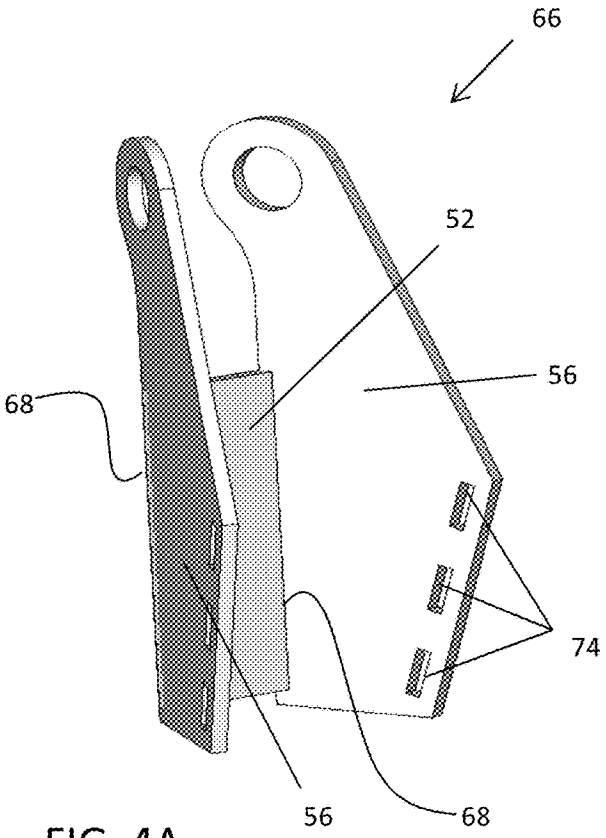
FIG. 4A illustrates a perspective view of a portion of a termination for a belt of an elevator system according to an embodiment.
Figure 4:
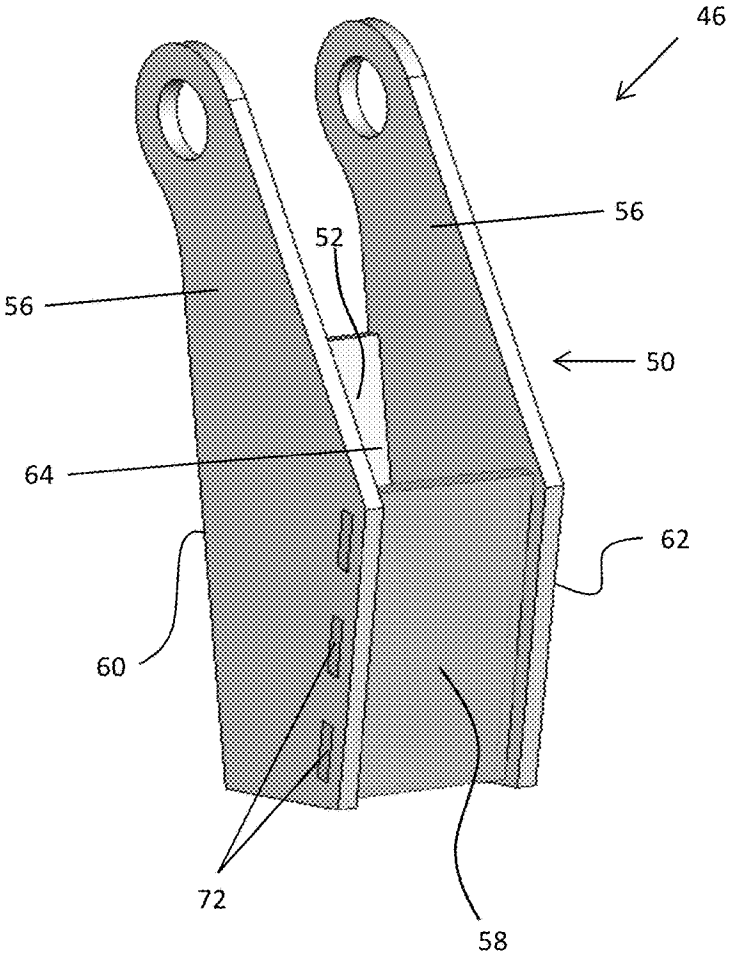
FIG. 4 illustrates a perspective view of a termination for a belt of an elevator system according to an embodiment.
Figure 5A:
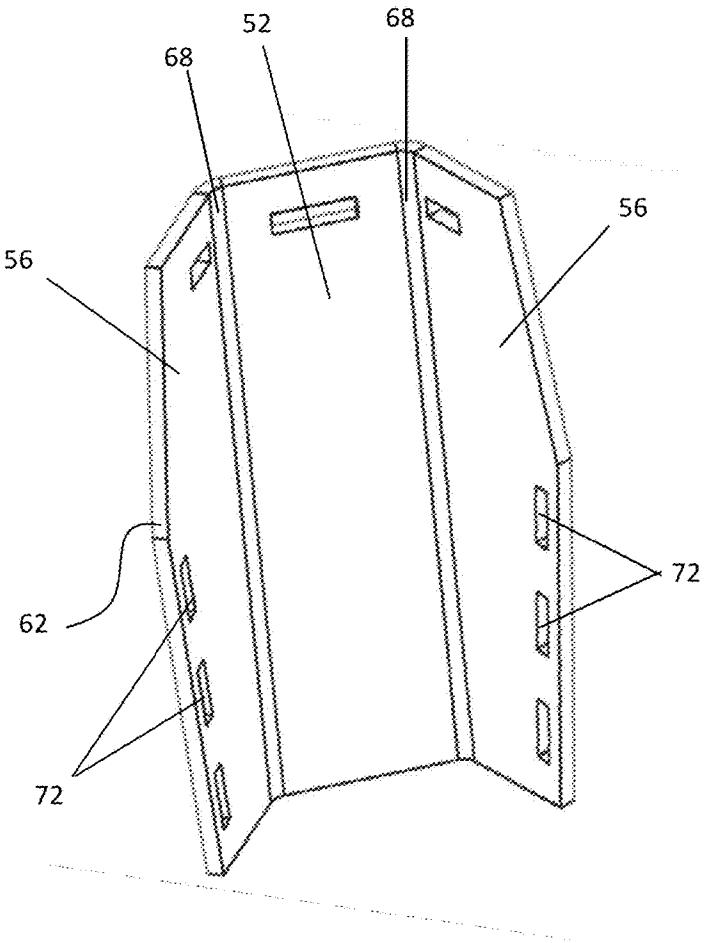
FIG. 5A illustrates a perspective view of a portion of a termination for a belt of an elevator system according to another embodiment.
Figure 5:
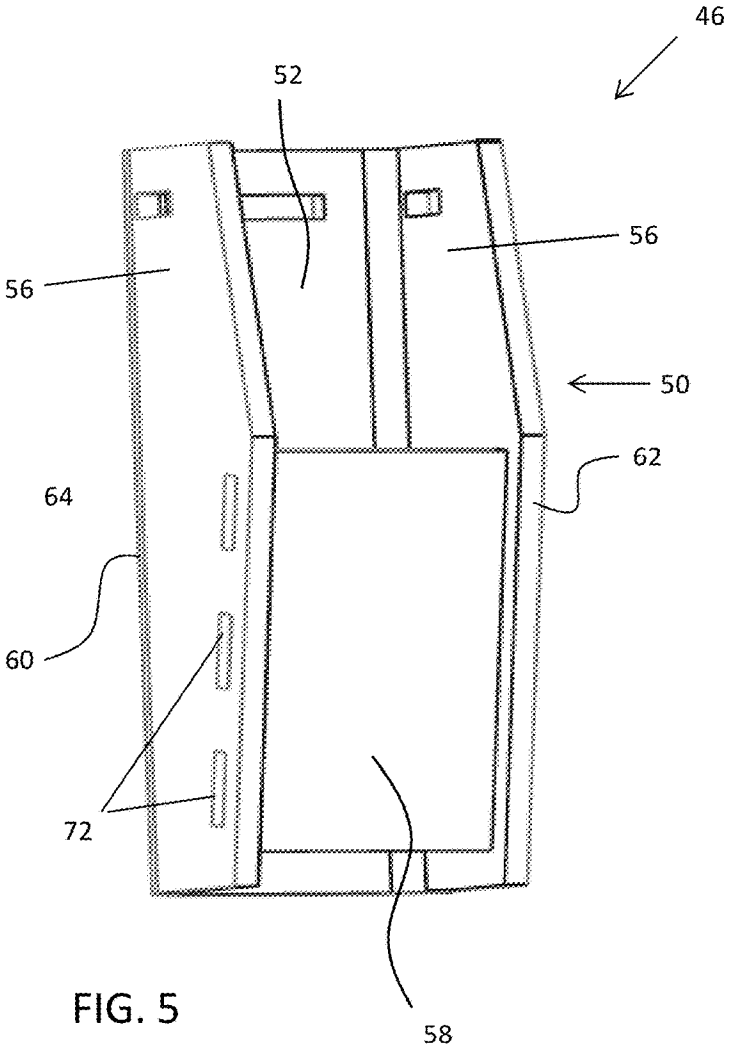
FIG. 5 illustrates a perspective view of a termination for a belt of an elevator system according to another embodiment.
Figure 6A:
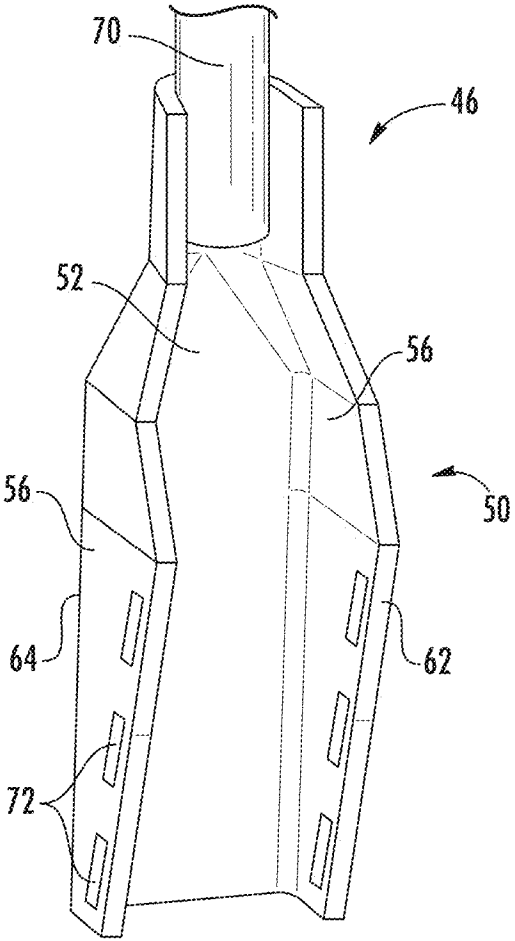
FIG. 6A illustrates a perspective view of a portion of a termination for a belt of an elevator system according to another embodiment.
Figure 6:
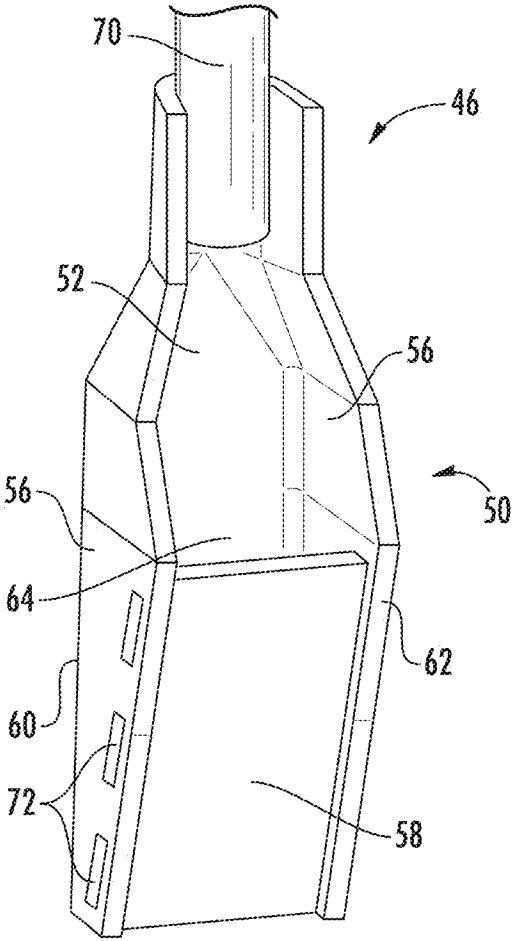
FIG. 6 illustrates a perspective view of a termination for a belt of an elevator system according to another embodiment.

Referring now to FIGS. 4-6, various embodiments of a termination 46 are illustrated. A belt end 48 of the belt 16 is installed and retained in the termination 46 at, for example, the elevator car 12 or the counterweight 22, as shown in FIG. 1. The termination 46 includes a housing 50 having a housing inner surface 52 tapering inwardly toward the belt 16 with increasing distance from the belt end 48. A wedge 54 is installed in the housing 50 so the belt 16 is received between the housing inner surfaces 52 and the wedge.

As shown, the housing 50 generally includes two face plates 56 and two side plates 58 extending between the two face plates 56. In an embodiment, the housing 50 is substantially symmetrical about a plane extending between and generally parallel to the two face plates 56. In an embodiment, the two face plates 56 are substantially identical and have a generally planar configuration, as shown in FIGS. 4 and 5. However, in other embodiments, such as shown in FIGS. 6 and 6A, the two face plates 56 may have substantially similar, but opposing orientations.

Each of the side plates 58 defines a housing inner surface 52 configured to engage a portion of the belt 16. The first side plate 58*a* is arranged generally adjacent a first side 60 of the housing 50 and the second side plate 58*b* is arranged generally adjacent an opposite side 62 of the housing 50. Accordingly, a socket 64 for receiving the belt end 48 and the wedge 54 is defined between the housing inner surfaces 52 and the adjacent surfaces of the face plates 56. The housing inner surfaces 52 generally include one or more friction enhancing features 57. Examples of suitable friction enhancing features include but are not limited to knurling, grooves, and/or a surface roughness for example.

At least one of the side plates 58 is integrally formed with one or more of the face plates 56 of the housing 50. In the illustrated, non-limiting embodiments, best shown in FIGS. 4A, 5A, and 6A, the two face plates 56 and the first side plate 58*a* are integrally formed from a single piece of material 66, such as sheet metal for example. However, it should be understood that embodiments where the second side plate 58*b*, alternatively or in addition to the first side plate 58*a*, is integrally formed with at least one face plate 56, is also within the scope of the disclosure. The overall shape of the at least one face plate 56 and the integral side plate 58 may be formed in the piece of material 66 via stamping, punching, or any other suitable manufacturing process. One or more bends 68 are then formed in the contoured piece of material 66 to define the corresponding walls in the housing, i.e. the two face plates 56 and the side plate 58. In embodiments where the bent piece of material 66 defines two face plates 56 and a side plate 58, the material is bent such that the two face plates 56 extend from opposing ends of the side plate 58 in the same direction, in a U-shaped configuration.

In an embodiment, the side plate 58 that is integrally formed with at least one face plate 56 may have an overall height equal to the face plate 56, as shown in FIG. 5. In another embodiment, the side plate 58 may have a reduced height compared to the adjacent face plate 56, as shown in FIG. 4, to reduce the overall material and weight of the termination 46. In addition, the first side plate 58*a* may be substantially aligned with or offset from a rod 70 (see FIG. 6) for connecting the termination 46 to a structure in the building and thereby transferring the suspension load acting on the tension member to the building structure. The rod may be fixed to the housing 50, or may be rotatable about an axis perpendicular to the face plates 56. This rotation may be enabled by a component or spacer connecting the rod 70 to the face plates 56. In embodiments where the first side plate 58*a* and the rod 70 are aligned, the first side plate 58*a* is arranged along the direction of the load being transferred form the elevator car to the building structure.

In embodiments where only one of the side plates is integrally formed with a face plate 56, the other side plates 58, for example, the second side plate 58*b*, may be formed with a plurality of plate tabs 72. Each plate tab 72 is insertable into a complimentary plate opening 74 formed in one of the face plates 56. In an embodiment, the second plate is arranged at a desired position while the piece of material 66 is bent. Accordingly, the piece of material 66 is bent in a manner to receive the tabs 72 within the openings 74 such that the face plates 56 engage and retain the second side plate 58*b* without any further action. However, it should be understood that any suitable means for coupling the side plate 58 to the face plates 56, such as welding or swaging the plate tabs 72 inserted within the plate openings 74 is also contemplated herein.

Figure 4B:
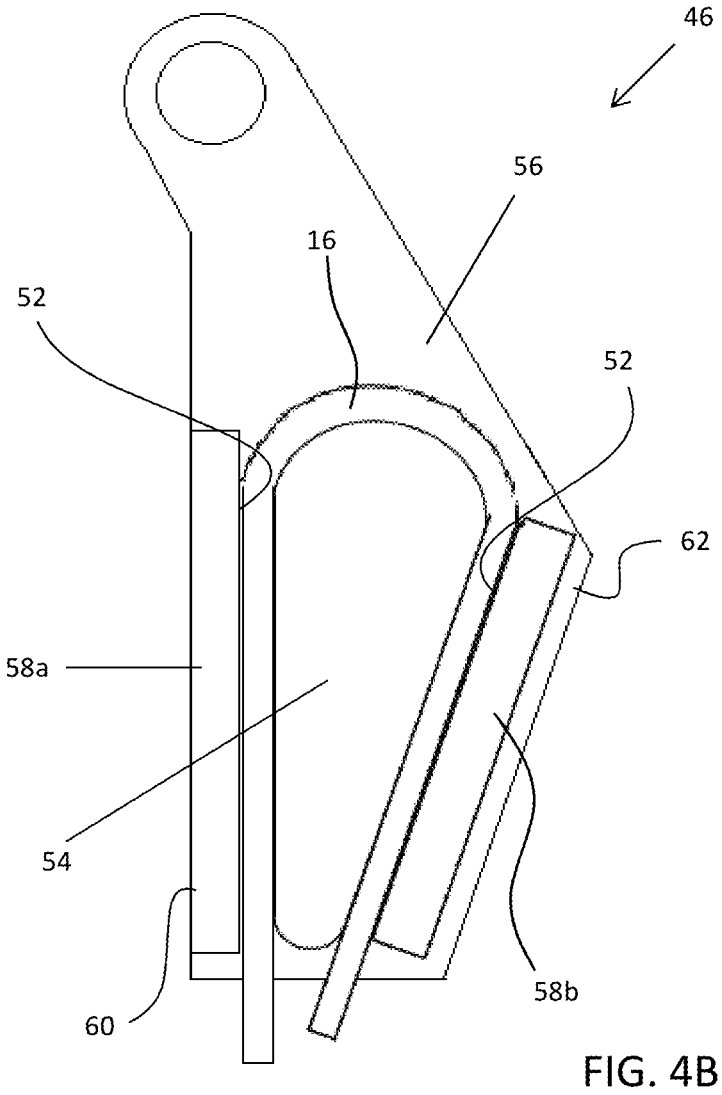
FIG. 4B illustrates a cross-sectional view of the termination of FIG. 4 according to an embodiment.

To install the belt end 48 into the termination 46, the belt end 48 is wrapped about the exterior surface of the wedge 54, and the wedge 54 and belt end 48 are inserted together into the socket 64 formed between the housing inner surfaces 52 and the face plates 56 (see FIG. 4B). When a load L is applied along the belt axis, the wedge 54 travels along the belt axis, and because of the taper of the housing inner surface 52 and the complimentary wedge outer surface, applies a clamping force F to the belt 16 to retain the belt at the termination 46. As the load increases the clamping force F similarly increases.

The termination disclosed herein has a reduced footprint defined by the U-shaped channel formed by bending the at least one integrally formed face plate 56 and side plate 58 without having to form the termination through an expensive casting process. In addition, the formation of the housing 50 eliminates the need for separate gripping inserts, thereby reducing the total number of parts and the complexity.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A termination device for a suspension member of an elevator system comprising:

a housing including a socket defined by first and second face plates and first and second side plates, wherein the first side plate is longer than the second side plate, wherein the first and second face plates are arranged opposite one another and the first and second sides plates extend between the first and second face plates, the first and second side plates being arranged opposite one another, wherein the first and second face plates and the first side plates are formed from a single piece on a first side of the housing, and the second side plate is coupled to the first and second face plates on a second side of the housing that opposes the first side of the housing so that the first and second face plates and the first side plate therebetween form a U-shaped configuration; and a wedge receivable within the socket with the suspension member, wherein the wedge is configured to cooperate with the housing to apply a clamping force to the suspension member in response to an axial load acting on the suspension member, wherein:

the second side plate forms a flat plate without defined openings and with plate tabs extend outwardly in opposing directions from opposing side edges of the flat plate; and each of the first and second face plates defines a plurality of plate openings at the second side of the housing, and the plurality of plate tabs are insertable into respective ones of the plurality of plate openings for securing the second side plate to the housing; and a rod, configured to connect the termination device to a building structure, is connected the first and second face plates at the first side of the housing and aligned with the first side plate.

2. The termination device of claim 1, wherein the housing is substantially symmetrical about a plane extending between and generally parallel to the first and second face plates.

3. The termination device of claim 1, wherein the second side plate is coupled to the first and second face plates without a weld.

4. The termination device of claim 1, wherein each of the first and second side plates defines a housing inner surface configured to engage the suspension member.

5. The termination device of claim 4, wherein the housing inner surface includes one or more friction enhancing features.

6. The termination device of claim 4, wherein the housing inner surface defined by at least one of the first and second side plates tapers inwardly toward the suspension member with increasing distance from the suspension member end.

7. An elevator system comprising:

a hoistway associated with a building structure;

an elevator car disposed in the hoistway;

a suspension member operably connected to the elevator car to suspend and/or drive the elevator car along the hoistway; and a termination device disposed in the hoistway and operably connected to an end of the suspension member, the termination device including:

a housing including a socket defined by first and second face plates and first and second side plates, wherein the first side plate is longer than the second side plate, wherein the first and second face plates are arranged opposite one another and the first and second sides plates extend between the first and second face plates, the first and second side plates being arranged opposite one another, wherein the first and second face plates and the first side plates are formed from a single piece on a first side of the housing, and the second side plate is coupled to the first and second face plates on a second side of the housing that opposes the first side of the housing so that the first and second face plates and the first side plate therebetween form a U-shaped configuration; and a wedge receivable within the socket with the suspension member, wherein the wedge is configured to cooperate with the housing to apply a clamping force to the suspension member in response to an axial load acting on the suspension member, wherein:

the second side plate forms a flat plate without defined openings and with plate tabs extending outwardly in opposing directions from opposing side edges of the flat plate; and each of the first and second face plates defines a plurality of plate openings at the second side of the housing, and the plurality of plate tabs are insertable into respective ones of the plurality of plate openings for securing the second side plate to the housing; and a rod, configured to connect the termination device to a building structure, is connected the first and second face plates at the first side of the housing and aligned with the first side plate.

8. The elevator system of claim 7, wherein the first side plate is arranged along a direction of load transfer from the elevator car to the building structure.

9. A method of manufacturing a termination device comprising:

contouring a piece of material associated with at least two sides of a housing;

bending the piece of material to form a first piece; and coupling a second piece to the first piece to form the housing wherein:

the housing includes first and second face plates and first and second side plates, wherein the first side plate is longer than the second side plate, wherein the first and second face plates are arranged opposite one another and the first and second sides plates extend between the first and second face plates, the first and second side plates being arranged opposite one another, the first and second face plates and the first side plates are formed from a single piece on a first side of the housing, and the second side plate is coupled to the first and second face plates on a second side of the housing that opposes the first side of the housing so that the first and second face plates and the first side plate therebetween form a U-shaped configuration;

the second side plate forms a flat plate without defined openings and with plate tabs extending outwardly in opposing directions from opposing side edges of the second flat plate;

each of the first and second face plates defines a plurality of plate openings at the second side of the housing, and the plurality of plate tabs are insertable into respective ones of the plurality of plate openings for securing the second side plates to the housing, a rod, configured to connect the termination device to a building structure, is connected the first and second face plates at the first side of the housing and aligned with the first side plate, and wherein bending the piece of material further comprises:

forming a first bend to define the first face plate integrally formed with the first side plate; and bending the piece of material further comprises forming a second bend to define the second face plate integrally formed with the first side plate, the first face plate and the second face plate being disposed on opposite ends of the first side plate.

10. The method of claim 9, wherein coupling the second piece to the first piece does not include welding the second piece to the first piece.

11. The method of claim 9, wherein bending the piece of material to form the first piece of the housing and coupling the second piece to the first piece occur simultaneously.

12. The method of claim 9, further comprising forming one or more friction enhancing features in the first and second side plates.

* * * * *